US011583005B2

(12) United States Patent
Deng et al.

(10) Patent No.: US 11,583,005 B2
(45) Date of Patent: Feb. 21, 2023

(54) ATOMIZER AND ELECTRONIC CIGARETTE HAVING SAME

(71) Applicant: Shenzhen First Union Technology Co., Ltd., Shenzhen (CN)

(72) Inventors: Yindeng Deng, Shenzhen (CN); Yonghai Li, Shenzhen (CN); Zhongli Xu, Shenzhen (CN); Xiaoqiang Zhao, Shenzhen (CN)

(73) Assignee: Shenzhen First Union Technology Co., Ltd., Shenzhen (CN)

( * ) Notice: Subject to any disclaimer, the term of this patent is extended or adjusted under 35 U.S.C. 154(b) by 574 days.

(21) Appl. No.: 15/999,365

(22) Filed: Aug. 21, 2018

(65) Prior Publication Data

US 2019/0274356 A1 Sep. 12, 2019

(30) Foreign Application Priority Data

Aug. 15, 2017 (CN) ..... 201721014680.8
Jul. 13, 2018 (CN) ..... 201821111823.1

(51) Int. Cl.
*A24F 40/46* (2020.01)
*A24F 40/485* (2020.01)
*A24F 40/10* (2020.01)

(52) U.S. Cl.
CPC ..... *A24F 40/46* (2020.01); *A24F 40/485* (2020.01); *A24F 40/10* (2020.01)

(58) Field of Classification Search
None
See application file for complete search history.

(56) References Cited

U.S. PATENT DOCUMENTS

2015/0335073 A1 11/2015 Li et al.
2017/0127728 A1 5/2017 Li et al.

FOREIGN PATENT DOCUMENTS

CN 105 476 072 A 4/2016
CN 205 865 985 U 1/2017
EP 3 179 829 A2 6/2017
EP 3 199 042 A1 8/2017

*Primary Examiner* — Phu H Nguyen

(57) ABSTRACT

An atomizer and an electronic cigarette having same include an atomizing sleeve with a liquid storage chamber formed therein; a mouthpiece is disposed at a top end of the atomizing sleeve; an air passage pipe is disposed at a center of the atomizing sleeve; a supporter with two ends opened is disposed at a bottom end of the air passage pipe; a hollow heating element is disposed in the supporter longitudinally; a side wall of the supporter has at least one liquid inlet hole communicated with the liquid storage chamber and configured for allowing radial infiltration of the tobacco liquid to the heating element; a sealing component is disposed between the heating element and the supporter to encircle the heating element and configured for avoiding leakage of the tobacco liquid along a longitudinal direction of the heating element.

12 Claims, 5 Drawing Sheets

ATOMIZER AND ELECTRONIC CIGARETTE HAVING SAME

CROSS REFERENCE TO RELATED APPLICATIONS

The present application claims priority to Chinese Patent Application CN 201721014680.8 filed on Aug. 15, 2017 and Chinese Patent Application CN 201821111823.1 filed on Jul. 13, 2018, which are hereby incorporated by reference herein as if set forth in its entirety.

TECHNICAL FIELD

The present disclosure relates to the field of smoking sets, and particularly, to an atomizer and an electronic cigarette having same.

BACKGROUND ART

In terms of the traditional cigarettes, the smoking smog contains tens of carcinogens during the tobacco cigarettes are combusted, for example tars etc. may endanger people's health. Moreover, the smoking smog is diffused throughout the air to form a secondhand smoke, inhaled by the people around to endanger their health. Therefore, most public areas prohibit smoking cigarettes explicitly, to satisfy some smokers' needs, the electronic cigarettes appeared.

Currently, the existing atomizer generally includes an atomizing sleeve and an atomizing core disposed inside the atomizing sleeve. The atomizing sleeve stores the tobacco liquid, the atomizing core is given the electricity to generate heat for heating the tobacco liquid to generate an aerosol for users' inhaling. The atomizing core generally includes a supporter, a porous ceramic body disposed inside the supporter, a heating wire disposed inside the porous ceramic body. In the prior art, there is a liquid storage cotton disposed between the supporter and the porous ceramic body. The liquid storage cotton conveys the tobacco liquid outside the supporter to the porous ceramic body on the hand, and is used for sealing, avoiding the tobacco liquid to leak out from clearance between the supporter and the porous ceramic body on the other hand.

Inventors in the present application find that the rate of conveying tobacco liquid by capillarity of the liquid storage cotton is slow that can't satisfy the user's need for big volume of aerosol, on the other hand, after the porous ceramic body is heated for a long time, the temperature of the porous ceramic body gets higher and higher, the liquid storage cotton clinging to the porous ceramic body will generate some eco-unfriendly materials due to the high temperature.

Therefore, it is a trend to cancel the liquid storage cotton, but a problem of sealing between the supporter and the porous ceramic body has to be solved.

SUMMARY

In view of the drawbacks in the prior art, the present disclosure relates to an atomizer of an electronic cigarette having a simple structure, less cost and effective of avoiding leakage of the tobacco liquid between the supporter and porous ceramic body.

To solve the above technical problems, an atomizer is disclosed including an atomizing sleeve with a liquid storage chamber formed therein, a mouthpiece is disposed at a top end of the atomizing sleeve, an air passage pipe is disposed at a center of the atomizing sleeve;

a supporter with two ends opened is disposed at a bottom end of the air passage pipe; a hollow heating element is disposed in the supporter longitudinally; a side wall of the supporter has at least one liquid inlet hole communicated with the liquid storage chamber and configured for allowing radial infiltration of the tobacco liquid to the heating element;

a sealing component is disposed between the heating element and the supporter to encircle the heating element and configured for avoiding leakage of the tobacco liquid along a longitudinal direction of the heating element.

Preferably, the sealing component has a silicone sleeve with a top end opened; and a through hole is formed on a bottom end of the silicone sleeve to communicate with the air passage pipe of the atomizer.

A side wall of the silicone sleeve has at least one opening, the opening of the silicone sleeve is aligned with the liquid inlet hole of the supporter.

Preferably, the sealing component has two first sealing units disposed at two ends of the heating element respectively; inner diameter of the supporter deducting outer diameter of the heating element is equal to a range of 0.1 mm to 1 mm, a liquid storage space is formed between inside wall of the supporter and outside wall of the heating element.

Preferably, the two first sealing unit are two first sealing rings sleeved on two ends of the heating element respectively, each end of the heating element has a first groove configured for accommodating the first sealing ring.

Preferably, the two first sealing units are two first sealing rings sleeved on two ends of the heating element respectively, each end of the heating element has a step, the two first sealing rings are disposed on the steps respectively; the heating element has a H-shaped section.

Preferably, the two first sealing units are two first tubes; each first tube with one end opened and a through hole formed on the other end thereof, is sleeved on each end of the heating element; the through holes are configured for communicating with the air passage pipe of the atomizer.

The heating element has a porous ceramic body and a heating wire disposed inside the porous ceramic body.

A thread sleeve is disposed at a bottom end of the atomizing sleeve; an electrode ring is disposed inside the bottom end of the atomizing sleeve; the thread sleeve and the electrode ring are isolated with each other by an isolating ring; one end of the heating wire is connected with the thread sleeve, the other end of the heating wire is connected with the electrode ring.

A connecting sleeve is disposed between a top end of the air passage pipe and the mouthpiece; a middle of the connecting sleeve has a bigger diameter while two ends of the connecting sleeve have a smaller diameter; the middle of the connecting sleeve has external screw threads, a bottom end of the mouthpiece has internal screw threads, the external screw threads of the connecting sleeve and the internal screw threads of the mouthpiece are engaged together to fix together.

A sealing ring is circular and disposed between the connecting ring and the mouthpiece.

A sealing cover is disposed to cover a top end of the atomizing sleeve, a middle of the sealing cover accommodates a bottom end of the mouthpiece and is connected tightly with the bottom end of the mouthpiece.

A sealing sleeve is disposed outside a bottom end of the supporter.

The atomizing sleeve, the air passage pipe, the supporter, the sealing sleeve and the sealing cover cooperatively defines a liquid storage chamber configured for storing tobacco liquid.

An electronic cigarette includes the aforementioned atomizer and a power supply set configured for supplying power to the atomizer.

Additional aspects and advantages of the present disclosure will be: the sealing component such as the silicone sleeve, the sealing rings or the sealing tubes is disposed between the heating element and the supporter, and the opening on the side wall of the silicon sleeve or the liquid storage space greatly ensures the rate of liquid inletting. Moreover, the assembling process of wrapping the sealing component around the heating element is beneficial for workers to operate, resulting in good consistency. Also the sealing component effectively separates the heating element from the liquid storage chamber which avoids leakage of the tobacco liquid.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
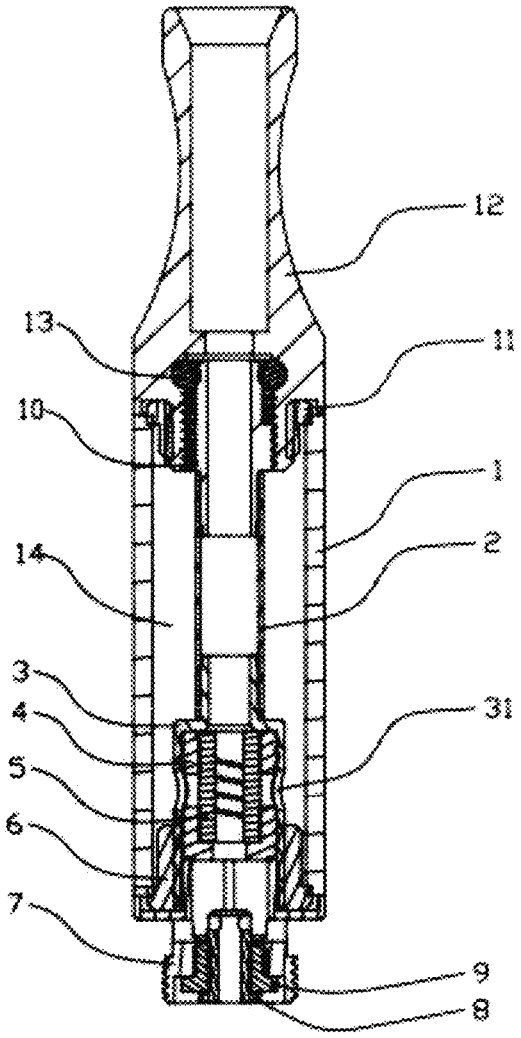
FIG. 1 is a cross-sectional view of an atomizer in accordance with a first embodiment of the present disclosure.
Figure 2:
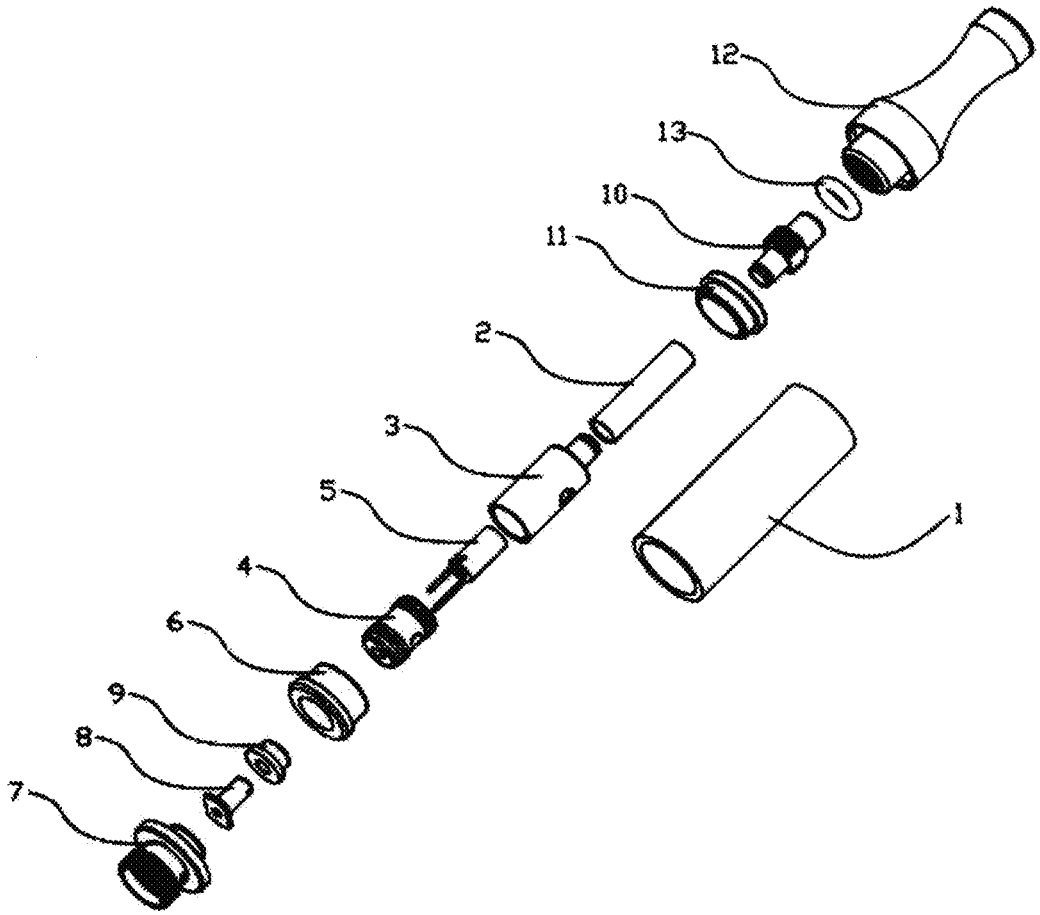
FIG. 2 is an exploded view of the atomizer in accordance with the first embodiment of the present disclosure.

Referring to FIG. 1 and FIG. 2, the present disclosure relates to an atomizer of an electronic cigarette. A bottom end of the atomizer is connected the power supply set. The atomizer has an atomizing sleeve 1; a mouthpiece 12 is disposed at a top end of the atomizing sleeve 1, an air passage pipe 2 is a hollow structure and disposed at a center of the atomizing sleeve 1; an top end of the air passage pipe 2 is communicated with the mouthpiece 12; a supporter 3 with two ends opened is disposed at a bottom end of the air passage pipe 2; a top end of the supporter 3 is a protruding cylindrical pipe, the cylindrical pipe protrudes into a bottom end of the air passage pipe 2 and is connected tightly with the bottom end of the air passage pipe 2, a bottom end of the supporter 3 is a hollow cylinder, the bottom of the cylinder is opened. At least one liquid inlet hole 31 is disposed on a side wall of the cylinder and communicated with the liquid storage chamber and configured for allowing radial infiltration of the tobacco liquid to the heating element, there are one liquid inlet hole 31 or a plurality of liquid inlet holes 31 provided thereon. A heating element 5 is disposed inside the cylinder of the supporter 3 longitudinally, the heating element 5 is a hollow structure that is communicated with the air passage pipe 2. In some embodiments, the heating element 5 is a porous ceramic body 27, a heating wire 24 is integrated with inside the porous ceramic body 27, the heating wire 24 encircles inside the ceramic body 27 which allows the heating element 5 to heat even, and aids atomization of the tobacco liquid. In some embodiments, the heating element 5 is an isolating body and the heating wire 24 encircles inside the heating element 5 (i.e. the isolating body). A sealing component is disposed between the heating element 5 and the supporter 3 to encircle the heating element 5 and configured for avoiding leakage of the tobacco liquid along a longitudinal direction of the heating element 5.

In a first embodiment of the present disclosure, the sealing component has a silicone sleeve 4 with a top end opened; and a through hole is formed on a bottom end of the silicone sleeve 4 to communicate with the air passage pipe 2 of the atomizer.

A side wall of the silicone sleeve 4 has at least one opening 210, the opening is aligned with the liquid inlet hole 31. As shown in FIG. 1 and FIG. 2, there are two openings 210 symmetrically disposed on the side wall of the silicone sleeve 4. In some embodiments, there are more than two openings 210.

In other embodiments of the present disclosure, the sealing component has two first sealing units 23 disposed at two ends of the heating element 5 respectively; inner diameter of the supporter 3 deducting outer diameter of the heating element 5 is equal to a range of 0.1 mm to 1 mm, a liquid storage space 20 is formed between inside wall of the supporter 3 and outside wall of the heating element 5. The first sealing units 23 are made of elastic rubber or plastic materials, an outer diameter of the first sealing unit 23 is bigger than an inner diameter of the supporter 3, when the first sealing unit 23 carried on the heating element 3 is inserted into the supporter 3, inside wall of the supporter would squeeze the first sealing unit 23 to make elastic deformation of the first sealing unit 23 so that the first sealing units 23 abut tightly with the inside wall of the supporter 3, which may also avoid leakage of the tobacco liquid from the longitudinal direction of the liquid storage space 20, that is, from two ends of the liquid storage space 20.

Figure 3:
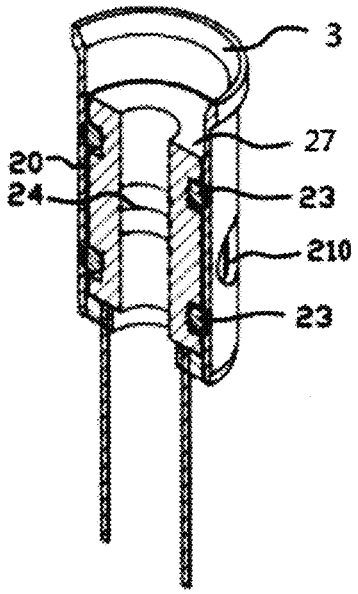
FIG. 3 is a sectional view of a sealing component disposed between the heating element and the supporter in accordance with a second embodiment of the present disclosure.
Figure 4:
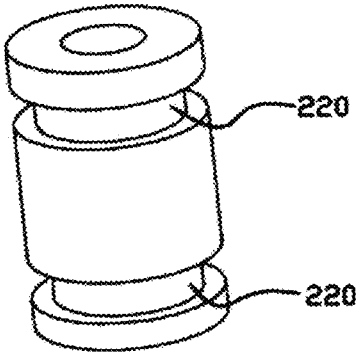
FIG. 4 is an aspect view of the heating element in FIG. 2.

In a second embodiment of the present disclosure, as show in FIG. 3 and FIG. 4, the two first sealing unit 23 are two first sealing rings 23 sleeved on two ends of the heating element 5 respectively, each end of the heating element 5 has a first groove 220 configured for accommodating the first sealing ring 23. In assembly, firstly the first sealing rings 23 are respectively disposed in the first grooves 220 of the heating element 5, then inserted into the supporter 21, the elastic deformation of the first sealing rings 23 after assembled may also avoid leakage of the tobacco liquid from the longitudinal direction of the liquid storage space 20.

Figure 5:
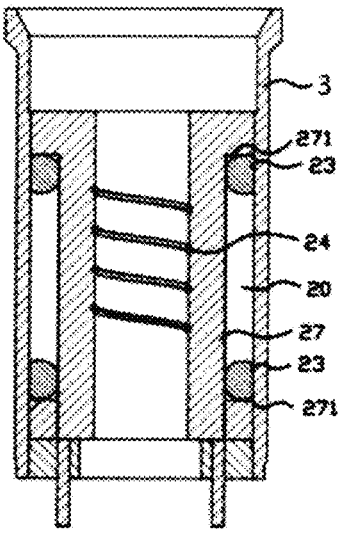
FIG. 5 is a cross-sectional view of the sealing component disposed between the heating element and the supporter in accordance with a third embodiment of the present disclosure.

In a third embodiment of the present disclosure, as shown in FIG. 5, the two first sealing units 23 are two first sealing rings 23 sleeved on two ends of the heating element respectively, each end of the heating element 5 has a step 271, the two first sealing rings are positioned on the steps 271 respectively; the heating element 5 has a H-shaped section, the elastic deformation of the first sealing rings 23 after assembled may also avoid leakage of the tobacco liquid from the longitudinal direction of the liquid storage space 20.

Figure 6:
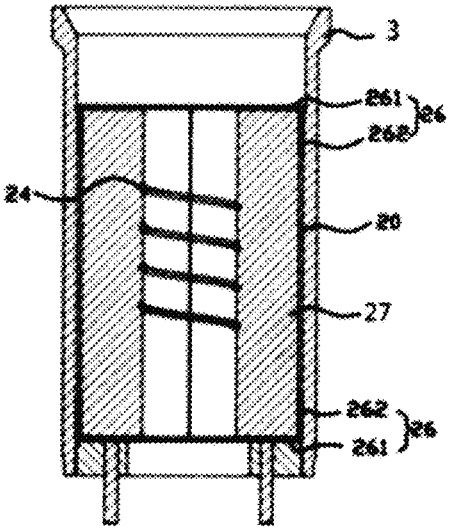
FIG. 6 is a cross-sectional view of the sealing component disposed between the heating element and the supporter in accordance with a fourth embodiment of the present disclosure.
Figure 7:
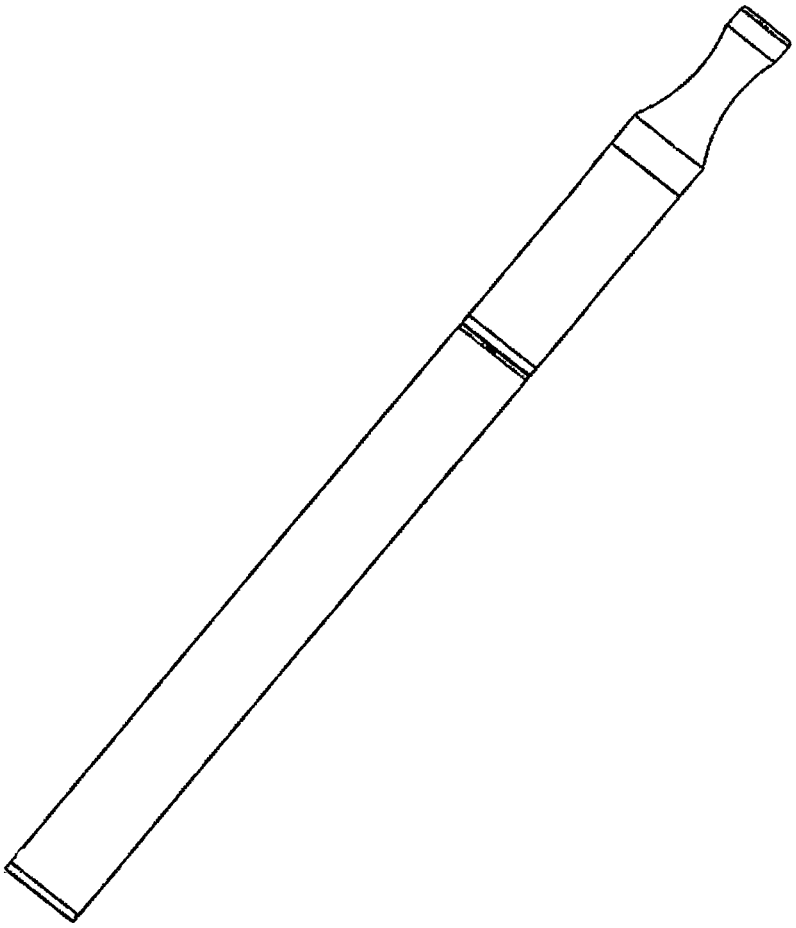
FIG. 7. is an isometric view of an electronic cigarette having the atomizer in accordance with embodiments of the present disclosure.

In a fourth embodiment of the present disclosure, as shown in FIG. 6, the two first sealing units 23 are two first tubes 26; each first tube 26 includes a plate shaped part 261 and a cylinder shaped part 262; the plate shaped part 261 has a through hole formed thereon, the cylinder shaped parts 262 are respectively sleeved on two ends of the heating element 3; the through holes are configured for communicating with the air passage pipe 2 of the atomizer. The cylinder shaped part 262 sleeved on each end of the heating element 3 is elastically deformed between inside wall of the supporter 3 and outside wall of the heating element 3 which may also avoid leakage of the tobacco liquid from the longitudinal direction of the liquid storage space 20, that is two ends of the liquid storage space 20.

In the embodiments of the present disclosure, as shown in FIG. 1 and FIG. 2, a sealing sleeve 6 is disposed outside a bottom end of the supporter 3. A thread sleeve 7 is connected with inside the bottom end of the supporter 3. The thread sleeve 7 is also a hollow structure, of which a top end has a smaller diameter, the top end of the thread sleeve 7 protrudes into the bottom end of the supporter 3, a middle of the thread sleeve 7 has a bigger diameter; outer diameter of the middle of the thread sleeve 7 is equal with the outer diameter of the atomizer sleeve 1, which are seemed as a whole. In use, the bottom end of the thread sleeve 7 is connected with the power supply set. An electrode ring 8 is disposed at a bottom end of the atomizing sleeve 7; the thread sleeve 7 and the electrode ring 8 are isolated with each other by an isolating ring 9, the thread sleeve 7 and the electrode ring 8 are not contacted with each other directly. One end of the heating wire 24 in the heating element 5 is connected with the thread sleeve 7, the other end of the heating wire 24 is connected with the electrode ring 8.

A connecting sleeve 10 is disposed between a top end of the air passage pipe 2 and the mouthpiece 12; a middle of the connecting sleeve 10 has a bigger diameter while two ends of the connecting sleeve 10 have a smaller diameter; the middle of the connecting sleeve 10 has external screw threads. A bottom end of the connecting sleeve 10 protrudes inside the top end of the air passage pipe 2 and is connected tightly with the top end of the air passage pipe 2. A bottom end of the mouthpiece 12 has internal screw threads, the external screw threads of middle of the connecting sleeve 10 and the internal screw threads of the mouthpiece are engaged together to fix together. A sealing cover 11 is disposed to cover a top end of the atomizing sleeve 1, a middle of the sealing cover accommodates a bottom end of the mouthpiece 12 and is connected tightly with the bottom end of the mouthpiece 12. A sealing ring 13 is circular and disposed between a top end of the connecting sleeve 10 and the mouthpiece 12, to strengthen air-tightness to avoid leakage of the tobacco liquid that may influence the using experience of the electronic cigarette.

The atomizing sleeve 1, the air passage pipe 2, the supporter 3, the sealing sleeve 6 and the sealing cover 11 cooperatively defines a liquid storage chamber 14 configured for storing tobacco liquid. The liquid storage chamber 14 may be filled up with different tastes of tobacco liquid according to the users' favors. The above tobacco liquid may flow into the supporter 3 through the liquid inlet hole 31, then flow through the opening 210 of the silicone sleeve 4 in the first embodiment or the liquid storage space 20 in the second, third and fourth embodiments, eventually arrive at the porous ceramic body 27 of the heating element 5. When the user inhales, the built-in sensor may perceive the flow changing then the heating wire 24 is supplied electricity to heat. The tobacco liquid may be atomized to generate an aerosol. The aerosol, mixed with the air inhaled by the user, flows through the air passage pipe 2 of the atomizer, eventually flows out of the mouth piece 12 and is sucked out by the user.

In the embodiments of the present disclosure, an electronic cigarette is disclosed including the aforementioned atomizer and a power supply set configured for supplying power to the atomizer.

Terminology used herein is for the purpose of describing particular embodiments only and is not intended to be limiting of the invention. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer of an electronic cigarette, comprising:

an atomizing sleeve with a liquid storage chamber formed therein;

a mouthpiece is disposed at a top end of the atomizing sleeve; and an air passage pipe is disposed at a center of the atomizing sleeve;

wherein a supporter with two ends opened is disposed at a bottom end of the air passage pipe; a hollow heating element is disposed in the supporter longitudinally; a side wall of the supporter has at least one liquid inlet hole communicated with the liquid storage chamber and configured for allowing radial infiltration of the tobacco liquid to the heating element;

a sealing component is disposed between the heating element and the supporter to encircle the heating element and configured for avoiding leakage of the tobacco liquid along a longitudinal direction of the heating element;

wherein the heating element is a porous ceramic body;

wherein a liquid storage space is formed between inside wall of the supporter and outside wall of the heating element;

wherein the sealing component has two first sealing units disposed at two ends of the heating element respectively;

wherein the two first sealing units are two first sealing rings sleeved on two ends of the heating element respectively, each end of the heating element has a first groove configured for accommodating the first sealing ring.

2. The atomizer according to claim 1, wherein the sealing component has a silicone sleeve with a top end opened and a through hole formed on a bottom end thereof; the through hole is configured to communicate with the air passage pipe of the atomizer.

3. The atomizer according to claim 2, wherein a side wall of the silicone sleeve has at least one opening, the opening of the silicone sleeve is aligned with the liquid inlet hole of the supporter.

4. The atomizer according to claim 1, wherein inner diameter of the supporter deducting outer diameter of the heating element is equal to a range of 0.1 mm to 1 mm.

5. The atomizer according to claim 1, wherein a heating wire is disposed inside the porous ceramic body.

6. The atomizer according to claim 5, wherein a thread sleeve is disposed at a bottom end of the atomizing sleeve;

an electrode ring is disposed inside the bottom end of the atomizing sleeve; the thread sleeve and the electrode ring are isolated with each other by an isolating ring; and one end of the heating wire is connected with the thread sleeve while the other end of the heating wire is connected with the electrode ring.

7. The atomizer according to claim 1, wherein a connecting sleeve is disposed between a top end of the air passage pipe and the mouthpiece; a middle of the connecting sleeve has a bigger diameter while two ends of the connecting sleeve have a smaller diameter; the middle of the connecting sleeve has external screw threads, a bottom end of the mouthpiece has internal screw threads, the external screw threads of the connecting sleeve and the internal screw threads of the mouthpiece are engaged together to fix together.

8. The atomizer according to claim 7, wherein a sealing ring is circular and disposed between the connecting sleeve and the mouthpiece.

9. The atomizer according to claim 1, wherein a sealing cover is disposed to cover a top end of the atomizing sleeve, a middle of the sealing cover accommodates a bottom end of the mouthpiece and is connected tightly with the bottom end of the mouthpiece.

10. The atomizer according to claim 9, wherein a sealing sleeve is disposed outside a bottom end of the supporter.

11. The atomizer according to claim 10, wherein the atomizing sleeve, the air passage pipe, the supporter, the sealing sleeve and the sealing cover cooperatively defines a liquid storage chamber configured for storing tobacco liquid.

12. An electronic cigarette, comprising:

an atomizer, comprising:

an atomizing sleeve with a liquid storage chamber formed therein;

a mouthpiece is disposed at a top end of the atomizing sleeve; and an air passage pipe is disposed at a center of the atomizing sleeve;

wherein a supporter with two ends opened is disposed at a bottom end of the air passage pipe; a hollow heating element is disposed in the supporter longitudinally; a side wall of the supporter has at least one liquid inlet hole communicated with the liquid storage chamber and configured for allowing radial infiltration of the tobacco liquid to the heating element;

a sealing component is disposed between the heating element and the supporter to encircle the heating element and configured for avoiding leakage of the tobacco liquid along a longitudinal direction of the heating element; and a power supply set, configured for supplying power to the atomizer;

wherein the heating element is a porous ceramic body;

wherein a liquid storage space is formed between inside wall of the supporter and outside wall of the heating element;

wherein the sealing component has two first sealing units disposed at two ends of the heating element respectively;

wherein the two first sealing units are two first sealing rings sleeved on two ends of the heating element respectively, each end of the heating element has a first groove configured for accommodating the first sealing ring.

* * * * *